US008048270B2

(12) United States Patent
Peltonen et al.

(10) Patent No.: US 8,048,270 B2
(45) Date of Patent: Nov. 1, 2011

(54) APPARATUS FOR DISTRIBUTING A PULP FLOW

(75) Inventors: Kari Peltonen, Karhula (FI); Janne Vehmaa, Siltakylä (FI)

(73) Assignee: Andritz Oy, Helsinki (FI)

( * ) Notice: Subject to any disclaimer, the term of this patent is extended or adjusted under 35 U.S.C. 154(b) by 435 days.

(21) Appl. No.: 11/912,260

(22) PCT Filed: Apr. 21, 2006

(86) PCT No.: PCT/FI2006/000123

§ 371 (c)(1),
(2), (4) Date: Oct. 8, 2008

(87) PCT Pub. No.: WO2006/111607

PCT Pub. Date: Oct. 26, 2006

(65) Prior Publication Data

US 2009/0071619 A1 Mar. 19, 2009

(30) Foreign Application Priority Data

Apr. 21, 2005 (FI) ..... 20050416

(51) Int. Cl.
*D21F 1/00* (2006.01)

(52) U.S. Cl. ..... 162/232

(58) Field of Classification Search ..... 162/232, 162/243, 246, 52, 258, 56, 242; 137/557, 137/883, 597; 366/150, 154
See application file for complete search history.

(56) References Cited

U.S. PATENT DOCUMENTS

| | | | | |
|---|---|---|---|---|
| 4,964,950 | A * | 10/1990 | Niskanen et al. | 162/100 |
| 5,228,829 | A | 7/1993 | Niskanen et al. | |
| 6,047,729 | A * | 4/2000 | Hollister et al. | 137/557 |
| 6,321,782 | B1 * | 11/2001 | Hollister | 137/557 |
| 6,325,890 | B1 * | 12/2001 | Prough et al. | 162/52 |
| 6,336,993 | B1 * | 1/2002 | Stromberg | 162/10 |
| 6,551,462 | B2 * | 4/2003 | Prough et al. | 162/243 |
| 2004/0040684 | A1 | 3/2004 | Henricson | |

FOREIGN PATENT DOCUMENTS

| | | |
|---|---|---|
| FI | 94442 | 5/1995 |
| SU | 477289 | 10/1975 |
| WO | WO 86/04369 | 7/1986 |

OTHER PUBLICATIONS

International Search Report mailed Jul. 21, 2006.

* cited by examiner

*Primary Examiner* — Mark Halpern
(74) *Attorney, Agent, or Firm* — Nixon & Vanderhye P.C.

(57) ABSTRACT

An apparatus for distributing a pulp flow, said apparatus including: a valve body connected to an inlet conduit and an outlet conduit for the pulp flow and provided with a closing member for opening and closing the valve to regulate the pulp flow; a distribution member arranged in a direction the pulp flow and downstream of the closing member, said distribution member distributing the pulp flow into at least two partial flows, and at least two channels wherein each channel receives a respective one of the two partial flows, wherein said channels are connected to the valve body or to the outlet conduit from the valve.

26 Claims, 2 Drawing Sheets

APPARATUS FOR DISTRIBUTING A PULP FLOW

CROSS RELATED APPLICATION

This application is the U.S. national phase of International Application No. PCT/FI2006/000123 filed 21 Apr. 2006 which designated the U.S. and claims priority to FI 20050416 filed 21 Apr. 2005, the entire contents of each of which are hereby incorporated by reference.

BACKGROUND OF THE INVENTION

The present invention relates to an apparatus for dividing pulp flows in a pulp or paper production process.

The flow of medium-consistency pulp is regulated mainly by means of a flow meter and a pulp flow valve. The flow meter is located in a pipeline prior to or after the pulp flow valve and the flow is regulated by changing the opening angle of the valve. This kind of pulp flow regulation is usually reliable and ensures the exact desired flow rate in all situations.

If pulp is to be splitted into two separate flow channels, it is typical that the splitting is effected by arranging two flow measurements and two regulation valves in parallel so that the desired flow may be set in both pipe lines, either independently of each other or by connecting the regulators to each other so that the regulators distribute the pulp into the desired pipe lines. With this arrangement, all process solutions relating to pulp distribution may be realized reliably and the regulators may be separated from each other and controlled independently.

However, there are several mill applications where absolutely exact distribution between the pipelines is not needed. The distribution may be considered successful, if the pulp is divided with an accuracy of at least 40/60% between the pipelines and there is no need to change the distribution ratio of the pulp in the process, but it is typical for the process in its continuous operation. This kind of situation prevails in several pulp washing apparatuses, e.g. in the DrumDis-placer®-drum washer, wherein the pulp is fed onto the washer drum through a feed box extending to the whole length of the drum. The pulp entering the washer is distributed into two or more pipelines, via which the pulp is led to various locations in the pulp feed box, but finally the pulp enters one and the same hydraulic space. Thus, the final equalizing of the pulp takes place only after the distribution and in view of the process this equalizing of the distribution is adequate.

At low consistency, less than 6%, the properties of pulp are similar to those of liquid, whereby regulation for distributing the pulp into different pipelines may be carried out by means of suitable pipeline design using e.g. hydraulic elbows, T-branches, reductions and other suitable pipe fittings. In these, the flow resistances are designed so that after the distribution the pulp encounters an equal flow resistance in both branches, whereby the flow resistances do not guide the distribution of the pulp. Pipe fittings, in which mixing is effected by means of reduction/enlargement of the pipe can be used only, if the amount of material flowing into each pulp line is the same, but absolutely exact distribution between the lines is not required. This kind of distribution systems have been used e.g. in feed pipings for vacuum drum filters and feed pipings for low-consistency-fed drum washers, e.g. Drum-Displacer®-washers. Additionally, the same system has been applied in feed pipings for pulp screening plants, where the pulp to be distributed is to be made to mix in the distribution point and thus fed to two different devices in as similar form as possible.

Distribution of medium-consistency (6-16%, especially 8-14%) pulp has mainly been carried out using piping provided with flow measuring and a valve, and automation. In some systems, the distribution of the pulp has been boosted e.g. by means of turbulence-generating members or piping design, but the main regulation has been effected by means of a valve and flow control. This has been a typical constructional solution, because medium-consistency pulp flow causes such a flow resistance that turbulence generated by the distribution of the pulp by means of piping is as such not adequate for maintaining the mixing required for the distribution, but as a rule, flow resistances after the distribution point effect the distribution. If the pulp flow stops in a flow channel or pipe after the distribution point, the force required for compensating for the static friction is even in a short piping so great that it is not possible to enforce the flow, but the pulp keeps flowing via the other channel only, despite the greater flow resistances. Flow properties of medium-consistency pulp have been described by e.g. Gullichsen et al., Tappi, 64 (1981) No. 6, p. 69-72.

In order to enable uniform feeding of medium-consistency pulp into an apparatus, e.g. into said washer feed box, the feeding is to be effected via more than one feed pipe, into which pipes the pulp is distributed from the main line. In such a case, each feed pipe typically has to be provided with a regulation valve and a flow meter, as described in the above. The flow meters dose the same amount of pulp into each feed pipe, and the desired flow volume is ensured by a proper position of the valves. This kind of arrangement is needed, because none of the feed pipes may get clogged, but continuous operation of all the pipes is inevitable. As the apparatus size increases, this results in a large number of regulation valves and flow meters, which thus involves an increase in costs.

Our new studies have revealed that an exactly equal flow volume in every feed pipe is not absolutely inevitable. This is true especially when the pulp is ultimately led from the feed pipes into one and the same undivided space, wherein the pulp flow will equalize anyway. Thus, the distribution of the pulp into the feed pipes does not have to be so uniform that it would require regulation by flow meters, but a resulting problem is the clogging risk of the feed pipes without flow control.

SUMMARY OF THE INVENTION

An object of the invention is to provide for a method and an apparatus for facilitating controlled flow distribution of a fiber suspension, especially a medium consistency fiber suspension, utilizing a simplified apparatus compared to prior art and thus decreasing the costs.

The apparatus is applicable for all fiber and water slurries independent of whether the pulp has been produced chemically by acid or alkaline cooking or whether the fibers have been mechanically separated from each other using different kinds of refiners or by grinding, or whether any chemical has been utilized in the mechanical treatment. However, the invention is most advantageous in a fiber line for chemical sulfate or sulfite pulp immediately after cooking and up to the end of the fiber line, and in applications for treating pulp in a drying apparatus. Of course, the arrangement may be considered preferable at a paper mill and other plants, which process cellulose-containing pulp.

Typically, the present invention is utilized for distributing chemically produced wood-based sulfate and sulfite pulp flows, but there are no limitations concerning various fibrous raw materials, such as straw or bagasse, or pulps produced by different methods, such as mechanical pulps (e.g. TMP, ground wood pulp, CTMP), recycled pulp or applications thereof.

The invention relates to an apparatus for distributing a pulp flow, said apparatus comprising a valve body connected to inlet and outlet conduits for the pulp flow and being provided with a closing member for opening and closing the valve and for controlling the flow, and it is characterized in that the apparatus further comprises

- a member arranged in the flow direction after the closing member for dividing the pulp flow into at least two partial flows, and
- at least two channels connected to the valve or the outlet conduit of the valve for the partial flows.

The arrangement according to the present invention is applicable when the pulp is at medium consistency range, 6-16%, more preferably 8-14%. However, in view of the consistency of the pulp, it is not essential that the pulp is medium-consistency (MC) pulp, but the system according to the invention may also be applied at a consistency range below 6%, but above 2%.

A characterizing feature of the present invention is that downstream of the closing member for the valve, a separate flow-distributing member is arranged inside the valve and/or inside the pipe or channel in connection thereto. Conventionally, T-pieces or corresponding branch tees are used for flow distribution, which nevertheless are part of the pipe or piping.

After the distribution, the partial flows are directed each via a separate channel or pipe or corresponding either to one and the same space, such as the feed box for the washer, or to different spaces, such as various pulp treatment apparatuses. The pressure prevailing in the receiving space affects the distribution of the pulp into partial flow channels. If the partial flows are led to different spaces, it is advantageous if an essentially equal pressure prevails in these spaces, whereby the pulp is distributed evenly into different partial flows. If different pressures prevail in the receiving spaces, the pulp is distributed into partial flows in proportion to the pressures. This is to be taken into account in the dimensioning of the apparatus.

A basic starting point for the present invention is that new and less strict than before requirements are first determined for the distribution of the pulp flow into partial flows, and the result is estimated based on these requirements. Firstly, the distribution of the pulp takes place by means of a static member, whereby the proportions of pulp amounts distributed to each flow channel remain continuously essentially unchanged. A second feature is that a deviation in the amounts of pulp is accepted between the flow channels and that it is not essential to know the exact amount of pulp flowing in each channel or pipeline. Based on these requirements, the arrangement according to the invention utilizes an intense flow field generated by the valve, in which flow field the velocity of the pulp is essentially greater than in the piping. In this arrangement, the pulp flow regulation valve receives a control signal from the pressure prevailing upstream of the valve, the level regulator of the pulp tank, or the flow rate measurement prior to the valve. An essential characteristic of the invention is that in the vicinity, preferably in the immediate vicinity of the closing member of this valve, typically a ball valve or a segment valve, the outflow has been mechanically split into at least two parts so that the splitting takes place in the rapid flow zone of the outflow from the valve. The rapid flow zone refers to a zone after the throttling of the flow from the valve, where the flow has not converted to a uniform plug flow. This zone after the valve may extend to some tens of millimeters only, i.e. less than 50 mm, but after a large pulp flow valve placed immediately after pumping the plug flow does not start until about 500-1000 mm after the valve.

Nevertheless, for the distribution of the pulp, the flow distribution member has to be located based on the assumption that in view of the distribution the most efficient distance is less than 3 D, where D is the diameter of the outflow flange of the valve, typically 0-1 D, of the outflow flange of the valve, although up to a distance of 6 D after the outflow flange the pulp flow may be rapid and partially or completely in a turbulent range.

Preferably the distribution member is located on the level of the outer flange (0 D), and more preferably as close to the closing member for the valve as possible, whereby the distribution member is at least partially located in the zone of the valve, i.e. its front edge in the flow direction is located in the zone of the valve, i.e. between the closing member and the outflow flange of the valve. Because the design of the closing members is different for different types of valves, the distance of the distribution member from the closing member cannot be unambiguously determined as an exact numerical value. Typically, it may be stated that the distance of the distribution member is less than 200 mm, preferably about 0-100 mm from the outflow flange of the valve, but most often the most preferable solution is that the distribution member is located inside the valve body or extends thereto.

The distribution of the pulp flow in the outflowing jet is effected by mounting a suitable member in the zone in question. The member has to be able to distribute the pulp flow into desired partial flows without essentially disturbing the actual flow. For example, the distribution member must not essentially slower the flow process. The member has to be such that it hampers the flow to the least possible extent, whereby the dynamics of the flow is even, without pulsation, and does not boost clogging of the flow, but it should allow arranging the construction of the piping to be opening. A preferable member is a plate-like piece. Because the distribution is preferably effected in the rapid and partially or completely turbulent zone of the outflow jet from the valve, the distance of the plate from the closing member of the valve, such as the outer periphery of the ball, according to a preferred embodiment of the invention is at the minimum 3 mm and at the maximum 300 mm, preferably 3-50 mm. If the tooling of the plate-like construction is made accurately, the plate can be installed even closer, even as close as 0.1-3 mm from the closing member of the valve. In this case the distribution member must be tooled carefully so that it does not hamper the operation of the valve. However, if any member is installed this close to the valve, the small clearance may lead to packing of the pulp between the valve and the plate, thus hampering the normal motion of the valve. The arrangement according to the invention ensures that the pulp flow traveling in the zone of the outflow jet from the valve finds it way far enough from the flow zone of the valve, whereby backflow of the pulp after the distribution point towards the closing member of the valve is prohibited.

The plate-like distribution member is typically a straight, planar plate. The distribution member may also have curved and/or angular shapes. That may be effected e.g. by forming the plate or plates curved, angled and/or angular. The distribution member may also be rod-like or wedge-shaped. The distribution member may also be formed of pieces arranged successively in essentially the same line, whereby one piece may be attached to the valve and the next to the pipe after the valve. The distribution member may also be formed of nested pipes installed concentrically or eccentrically in relation to each other.

The distribution member may be installed in the piping in a separate seat or it may be part of the valve. The construction and material of the valve must be such that they withstand the flow conditions. As an example, a plate-like or corresponding distribution member must be thick enough to withstand the loading caused by the flow, so that the plate does not begin to vibrate. Also, the distribution member must resist mechanical erosion.

Downstream of the flow distribution, the piping is preferably designed so that its basic construction is essentially symmetrical in relation to the valve, i.e. the flow channels or pipelines for the partial pulp flows have been arranged essentially symmetrically or they have an essentially equal flow resistance, and finally the pulp from the partial flow channels is led into partly or completely one and the same hydraulic space, such as a feed chamber or feed box of some treatment apparatus. Most preferably, downstream of the distribution the flow channels are completely symmetrical and their flow resistance is the same, but even small constructional differences change the situation. If the feeding of the pulp during the distribution is adequately intense, i.e. the pressure difference over the valve is great, the piping downstream of the flow distribution point may also be designed asymmetrical. When the problems resulting from asymmetricity have been taken into account, in some special cases the flow resistance in the piping may be essentially different, but a strong valve flow compensates the difference in the piping.

Because in some situations the aim is not to establish an equal flow in each flow channel, the flowing of the pulp can be routed more strongly to the consequential pipes in a ratio of 20/80%, 30/70% or 40/60%, to mention only a few exemplary distribution ratios, by the position of the plate, by the shaping of the plate, such as the form of chamfers, or by changing the centricity of the plate.

There are also cases where distribution of the pulp into two flows is not adequate, but the pulp has to be distributed into more, typically three or four flow channels. According to the state or art, the distribution of the pulp into four parts and thus four channels or pipes is an adequate degree, and an aim of the invention. However, the nature of the solution according to the invention is such that it allows for distributing the pulp into e.g. five or six channels and the technical basics of the solution do not change, even though the flow was distributed into 7-14 partial flows. Naturally, this calls for changing the forming of the plates distributing the pulp flow from that described above for obtaining additional distribution channels. In this case, a proper flow is ensured in such a way that the pulp flow is first divided into two flow channels by means of a small opening angle of the valve. As the opening angle of the valve increases and the amount of pulp in the flow increases, three or four sectors are arranged in the pulp flow from the valve, into which sectors the pulp flow is directed. An essential thing in this solution is that the plates placed in the flow exiting the valve are by some means arranged intersecting in relation to each other, whereby the line is first provided with a plate splitting the pulp flow partially or totally, in relation to which plate new plates are arranged intersecting and at different angles, said plates forming new channels in the flow direction only after the first two channels have been opened. It is thus essential that not all the plates distributing the pulp flow are parallel, which would make a uniform distribution difficult to accomplish, but the plates intersect each other at some point.

According to a preferred embodiment, the partial flows are led into one and the same hydraulic space. The arrangement according to the present invention ensures that when the flow is being distributed into two channels, an adequate distribution between different pulp inflow points in the hydraulic space is achieved. Due to adequate distribution, assisted by the traveling of the pulp, uniformity of the pulp in the subsequent common hydraulic space is achieved. As the flow volumes increase, in case of three and more flows new flow channels are opened as a function of the flow volumes for ensuring an adequate distribution. The principle of this embodiment is that not all the flow channels are opened immediately and simultaneously in the outflow jet from the valve right after the valve member, but two channels are opened first and not until a uniform unplugging flow having an adequate flow rate has been achieved in the two channels, new channels are opened for the pulp flow. This distribution system is further designed so that the aim is not to distribute the flow absolutely evenly, but the distribution is adequate when the main part of the flows is distributed between different partial flow pipelines. A further feature worth mentioning is that when during operation the flow is outside the design flow and the opening of the valve is not at a design angle, the flow is essentially more abundant in two flow pipes than in the others. If the situation is not desired in view of the subsequent process, regulation techniques can be utilized, a solution of which is disclosed later in the text.

If the pulp is to be distributed instead of two pipes into a greater number of, such as three or four channels, the situation in the jet from the valve changes significantly. In that case the distribution plates in the flow jet are to be installed so that the jet is distributed e.g. into four flow spaces of equal size. However, this distribution will not succeed in case the valve is used primarily for e.g. surface or pressure regulation, because changes in the flow volume result in changing of the opening of the valve despite the fact that in view of pulp distribution the changes must be small. A targeted opening angle must be set for the valve, which angle is 50-95%, preferably 60-85%. As the pulp flow over the distribution device varies between full production and half-production, the opening angle is to be adjusted accordingly by means of pressure upstream of the valve. When the pulp flow is half of the design flow, the pressure prior to the valve is lower than at full flow for maintaining the opening angle of the valve at the target value or close to it.

If the pulp is pumped by means of an MC-pump to the valve, the pressure prior to the valve may be regulated e.g. by installing a frequency converter, which regulates the pressure prior to the valve so that the opening of the valve remains within the desired values. If the pulp enters e.g. a washer at hydrostatic pressure, the automation application is to be created so that the set value of the surface level regulated by the valve changes according to production and the set value is corrected if the opening angle differs to an adequate extent from the optimal level. Additionally, the pressure prior to the valve can be regulated by installing two or more valves in series or by regulating the flow of dilution liquid to the valve, whereby the flow properties of the pulp change.

Most preferably the invention is applied in connection with ball valves and segment valves acting as regulation valves. However, the type of the valve is not essential in view of the invention, but the invention can be applied to most valve constructions.

At least the following advantages are achieved by means of the invention:

- reduced investment and installation costs,
- reduced workload in connection with the installation of the piping at the mill and reduced number of couplings between the piping and instrumentation,
- simplified mill especially in view of instrumentation and automation,
- possibility to standardize and modularize components to be installed in the plant and to reduce design work costs, and
- increased opportunities for prefabrication of plant components outside the mill area in order to expedite the installation work.

BRIEF DESCRIPTION OF THE DRAWINGS

The invention will be disclosed in more detail in the following with reference to the appended figures, of which

DETAILED DESCRIPTION OF THE INVENTION

Figure 1:
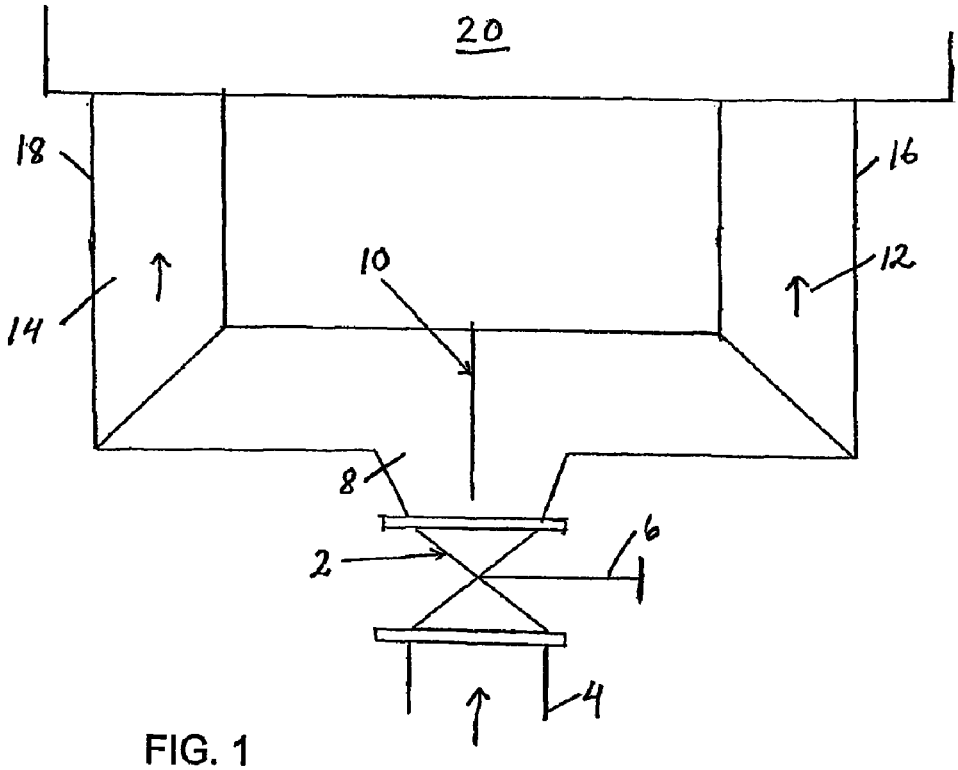
FIG. 1 is a schematic general view from above of a preferred apparatus solution according to the invention.

In the apparatus according to FIG. 1, the pulp is led into a regulation valve 2 via a feed conduit 4. The valve 2 is e.g. a ball valve or a segment valve, and the position of its closing member (not shown) is adjusted by means of a regulation spindle 6 protruding from the valve in order to change the opening angle of the valve. In accordance with the invention, a plate-like member 10 is arranged in the outlet conduit 8 of the valve for dividing the pulp flow exiting the valve into two partial flows, 12 and 14. Channels or pipes 16 and 18 are connected to the outlet conduit 8 of the valve, via which channels or conduits the partial flows of pulp 12 and 14 are led into one and the same continuous space 20, which is e.g. a washer feed box.

In FIG. 1 the distribution plate 10 is positioned lengthwise in the flow direction. The plate can also be positioned in some other suitable way, which allows for the desired distribution of the pulp flow.

Figure 2:
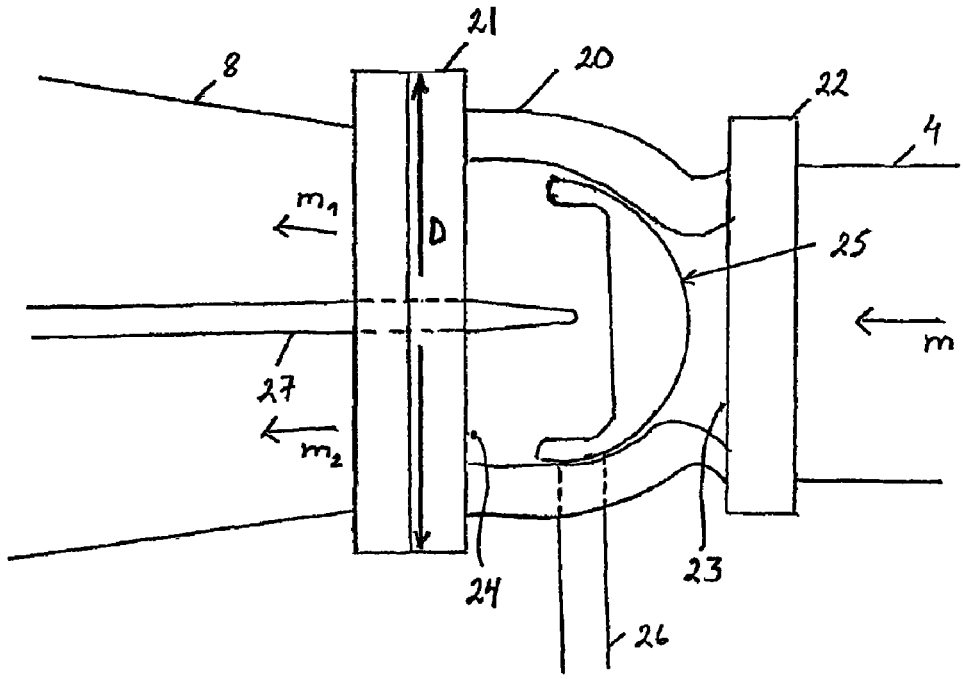
FIG. 2 is a schematic cross sectional view of a preferred embodiment of a valve and a flow distribution member according to the invention.

FIG. 2 illustrates a more detailed scheme of an embodiment according to the invention, illustrating a valve. The main components of the valve are a valve body 20 attached to pipe conduits 4 and 8 or corresponding by means of flanges 21 and 22 and inlet and outlet openings 23 and 24 in the valve body. A closing member 25 of the valve is arranged inside the valve body, with its actuators 26 known per se. The outlet side of the valve is according to the invention provided with a plate-like distribution member 27, which divides the pulp flow m through the valve into two partial flows, $m_1$ and $m_2$. The plate 27 is positioned perpendicularly in relation to the axis 26 of the actuator and lengthwise in the direction of the pulp flow (m).

In this embodiment, the distribution member 27 extends to the interior of the valve to the immediate vicinity of the closing member. Typically the distribution member is arranged after the closing member so that its distance from the outlet flange 21 of the valve is less than 3 times the diameter D of the outlet flange, i.e. less than 3 D.

Figure 3:
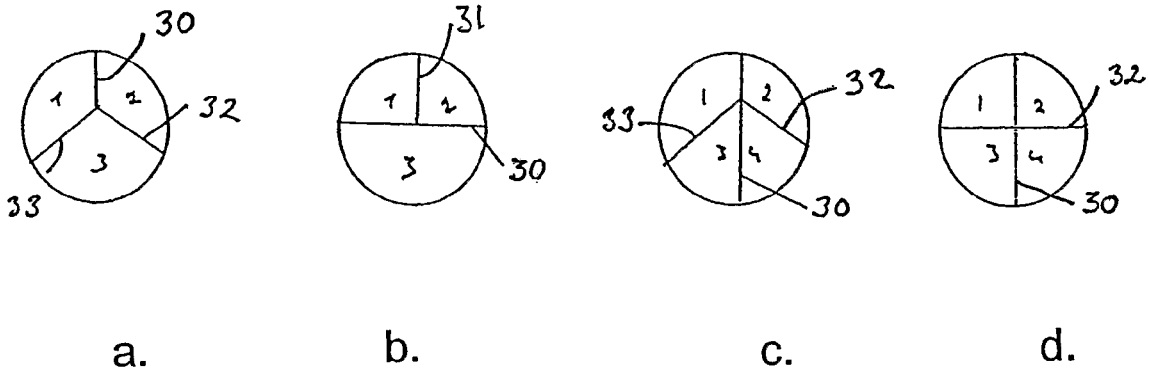
FIG. 3 is a schematic illustration of some preferred applications of use of a plate-like pulp flow distribution member.

FIG. 3 illustrates examples of how the pulp flow can be distributed into three or more partial flows by means of a plate-like distribution member, if the splitting of the pulp into two flows is not adequate. In this case a proper flow is ensured so that with a small opening angle of the valve the pulp flow is first divided into two flow channels, plate 30 in FIGS. 3*a*, 3*b* and 3*c*. When the opening angle increases and the amount of pulp in the flow increases, three or four sectors are arranged in the pulp flow from the valve, into which sectors the pulp flow is directed. The outflow jet from the valve is in the flow direction after plate 30 provided with an additional plate or additional plates so that the plates intersect in some way in relation to each other. In FIG. 3*a*, plates 32 and 33 are arranged intersecting with plate 30, whereby a third partial flow is obtained.

In FIG. 3*b*, a plate 31 is installed above a horizontal plate 30 and at right angle in relation to it. Thus, plate 30 divides the pulp flow first into two partial flows. Plate 31 located in the flow direction downstream of plate 30, divides one partial flow again to two flows, whereby finally three partial flows are obtained approximately in the ratio of 50%/25%/25%. In FIG. 3*c*, plate 30 also divides the flow first into two partial flows, after which these partial flows are again divided into two flows by means of plates 32 and 33 located at a sloping angle in relation to plate 30, whereby finally four partial flows are obtained. In FIG. 3*d*, four partial flows are formed by means of two plates 30 and 32 positioned perpendicularly in relation to each other. This way, the flow line is first provided with a plate splitting the pulp flow completely or partially, in relation to which plate new plates are installed at different angles and intersecting, which plates form new channels in the flow direction of the pulp only after the two first channels have been opened. Thus, it is essential that the plates splitting the pulp flow are not parallel, which would render an even distribution difficult, but at least part of the plates are intersecting in relation to each other.

Thus, essential features of the present invention include:

- The pulp flow is divided mechanically into two flows utilizing the outflow jet from the valve. The opening angle of the valve is not restricted, but it may be any angle, nevertheless preferably such that it is optimal in view of the sizing of the valve and the process itself. The distribution takes place in the rapid and in some cases turbulent flow field of the valve, whereby stopping of the fibrous network of the flowing medium-consistency pulp in the piping, its thickening and clogging of the piping are prohibited.
- If the pulp flow is distributed into three, four or more partial flows, the distribution member, preferably plates, in the outflow jet from the valve is arranged so that with an optimal opening angle of the valve, all compartments formed for the flow during the distribution have an equal size. The opening angle of the valve is on average kept at its optimal value by means of regulation technique.
- After the distribution, the pulp flow piping is preferably essentially symmetrical in relation to the valve and the flow resistance in the piping is designed to be essentially the same in respect of the fundamental values.
- After the distribution, the pulp flow piping leads the pulp into partially or completely one and the same space.

The apparatus according to the invention may be used in feeding arrangements for several pulp treatment apparatuses. The invention may be applied in all washing and thickening devices for pulp, in which pulp is fed in distributing it into at least two flows, after which the pulp is returned into a hydraulically common space. The small flow difference originating from the distribution can be compensated by flows in said one and the same hydraulic space.

The distribution systems according to the invention may also be connected in series, whereby by means of one pipe the pulp can be distributed into e.g. four or eight partial flow pipes. Thus, a uniform flow is obtained for a long distance.

The arrangement according to the invention may also be installed in parallel in connection with one pipe, whereby the valves, typically two (2), are located on the opposite sides of the pipe. According to the invention, a distribution member is arranged after each valve, whereby each valve serves for dividing the pulp flow into two partial flows, as a result of which a total number of four partial flows is obtained. When two valves are thus located at the sides of the pipe, the arrangement according to the invention provides a uniform distribution into four partial flows of pulp at all production rates. A fluidizing device or a plough-like member or a distribution plate may be installed at the inlet side and in the vicinity of the valves for contributing to uniform flow of pulp to the valves. This kind of embodiment of the invention is suitable especially when pulp is fed into a reactor or a tower.

On one hand, this kind of distribution of pulp is limited by deceleration of the flows and the size of the pipes. With medium-consistency pulp the smallest preferable pipes have a diameter of about 100 mm, more preferably 150 mm, but pipes larger than that can be used without problems. Smaller pipes can hardly be used. On the other hand, as the size of the pipe increases, the flow velocity of the pulp in the pipe decelerates and finally turns to pulsating, when the flow velocity decreases below 0.2 m/s during dimensioning. Thus, the piping is to be designed so that both provisions are met. It may be noted about these provisions that the flow velocity of the pulp has a minimum level, which in normal dimensioning may not be decreased. An example of a washing apparatus, in which the invention can be utilized, is a DrumDisplacer®—washer drum provided with a feed box of the length of the drum, into which feed box the partial flows of the pulp are led. As many other washing devices are also based on pulp being fed to the device via various pipelines or channels, the invention would be useful for e.g. press washer, for dividing pulp to two diffusers or pressure diffusers or other pressurized washing devices.

Other treatment apparatuses, in which the present invention may be utilized include screening devices, such as pressure screens, especially screens for high-consistency pulp, feed line for reactors and bleaching towers and distribution of pulp in the blow line of a digester or a pressurized reactor. In these applications, the method is being developed towards a more uniform regulation and the adjustment is carried out for the purpose of equalizing the flow.

The distribution device arrangement according to the invention can produce a highly uniform pulp flow, which is easy to control. Thus, it is possible to distribute the pulp so that it does not end up in one and the same hydraulic space, but is distributed inside one apparatus into clearly different compartments, which are separated from each other, or the pulp is divided to two different devices.

As to the consistency of the pulp, it is not essential that the pulp is medium-consistency (MC) pulp, but the system may also be applied at a consistency range of more than 2% and less than 6%. In that case the advantage may be considered to be that the distribution system as such forces the pulp to flow into two channels in the jet from the valve, whereby the later flow resistances and more exactly varying flow resistances do not have the same kind of influence on the distribution of the pulp as e.g. when operating with hydraulic elbows. Thus, the presented system is advantageous within a vary wide consistency range, but at different consistency ranges the advantages obtained utilizing it are similar, i.e. the distribution of the pulp in a zone of intensive flow leads to uniform flow rate between two or more channels.

The temperature of the pulp has no significance in the system, but the temperature may be set between 0-100° C. in systems with atmospheric pressure, but if the system is pressurized, 100° C. may be exceeded, provided that care is taken to ensure that with each pressure the operation is carried out below boiling point.

As the distribution member may be a simple plate-like member in the outflow jet from the valve, a preferred embodiment of the application is such that the position of the plate may be adjusted. If the aim is a precise desired distribution ratio and exact distribution is desired, fine adjustment may be carried out by moving the position of the plate or by assembling an active control mechanism in connection with the distribution member. This adjustment may be carried out at the simplest by:

1. changing the form of the distribution member, e.g. by rounding or shaping the member.
2. attaching the distribution member so that it can be removed and its position can be changed.
3. hinging or articulating the distribution member.
4. using a guide bar for moving the distribution member.
5. keeping the distribution member unmoved and changing the size of the outflow opening e.g. at the edge of the outflow opening with stationary or movable parts.

The separate regulation components can thus be movable, but at the simplest the distribution of the pulp can be regulated by changing the form of the flow opening or by filling it.

If the distribution member is stationary, but the changing the distribution is desired, it may be carried out by rotating the valve in relation to the distribution plate so that the axis of the actuator is not perpendicular to the distribution plate, whereby the feeding of the pulp takes place unilaterally. The distribution of the pulp thus regulated is most advantageous in one operation spot only, but this way, by rotating, the distribution may be regulated.

The invention is not limited to the presented exemplary embodiments, but it may be modified and applied within the inventive concept according to the appended claims.

The invention claimed is:

1. An apparatus for distributing a pulp flow, said apparatus comprising:

a valve body housing a valve, and connected to an inlet conduit and an outlet conduit for the pulp flow and provided with a closing member for opening and closing the valve to regulate the pulp flow;

a distribution member arranged in a direction of the pulp flow and downstream of the closing member and valve, said distribution member distributing the pulp flow into at least two partial flows, and at least two channels wherein each channel receives a respective one of the two partial flows, wherein said channels are connected to the valve body or to the outlet conduit from the valve.

2. An apparatus according to claim 1, wherein the distribution member is a plate.

3. An apparatus according to claim 1 wherein for distributing the pulp flow outflow from the valve body into at least three partial flows, the distribution member is formed of plates parallel to the flow direction and each plate divides two of the partial flows.

4. An apparatus according to claim 1, wherein the distribution member includes a tubular passage.

5. An apparatus according to claim 1, wherein the distribution member includes a bar.

6. An apparatus according to claim 1, wherein the partial flow channels are arranged symmetrically in relation to the distribution member.

7. An apparatus according to claim 1, wherein the partial flow channels are connected at a common location.

8. An apparatus according to claim 1 wherein the partial flow channels are connected to different spaces each having essentially equal pressure.

9. An apparatus according to claim 1, wherein the apparatus is arranged in a feed line for a pulp treatment apparatus.

10. An apparatus according to claim 9, wherein the pulp treatment apparatus is a pulp washer.

11. An apparatus according to claim 9, wherein the pulp treatment apparatus is a pulp screen.

12. An apparatus according to claim 9, wherein the pulp treatment apparatus is at least one of a pulp treatment tank, a bleaching tower and a reactor.

13. An apparatus according to claim 1, wherein the pulp flow has a consistency in a range of 6-16%.

14. An apparatus according to claim 1, wherein the pulp flow has a consistency of more that 2% and less than 6%.

15. An apparatus according to claim 1, wherein the valve body comprises a flange with which the outlet conduit is connected to the valve and which has a diameter, D, and a distance of the distribution member from the outflow flange of the valve is less than 3 times D.

16. An apparatus according to claim 1, wherein the distribution member is arranged at least partially inside the valve body.

17. A distribution apparatus for distributing a pulp flow, said apparatus comprising:

a valve body having an inlet conduit to receive the pulp flow from and an outlet conduit to discharge the pulp flow from the valve body, wherein the pulp flow flows in a pulp flow direction from the inlet to the outlet;

at least two outlet channels between the valve body and the outlet wherein the pulp flow from the valve body flows to the at least two outlet channels;

a valve housed in the valve body said valve having an open position allowing the pulp flow to the outlet and a closed position blocking pulp flow to the outlet; and a flow distributor downstream in the pulp flow direction of the valve and dividing the pulp flow passing through the outlet into at least two simultaneous pulp flows, wherein each pulp flow is directed by the distributor into a respective one of the at least two outlet channels.

18. The distribution apparatus as in claim 17 wherein the flow distributor has a length dimension parallel to the pulp flow direction.

19. The distribution apparatus as in claim 17 wherein the flow distributor is a plate parallel to the pulp flow direction and separating the at least two channels.

20. The distribution apparatus as in claim 17 wherein the outlet of the valve body is circular in cross section, and the flow distributor is an arrangement of at least three plates arranged parallel to the pulp flow direction.

21. The distribution apparatus as in claim 20 wherein the at least three plates are joined along a common line.

22. The distribution apparatus as in claim 21 wherein the common line is coaxial with the outlet.

23. A distribution apparatus for distributing a pulp flow, said apparatus comprising:

a valve body housing a valve, the valve body including an inlet conduit to receive the pulp flow from and an outlet conduit to discharge the pulp flow from the valve body, wherein the pulp flows through the valve body in a straight line pulp flow direction from the inlet to the outlet;

the outlet conduit is connected to at least two outlet channels wherein the pulp flows through the valve body, through the outlet and is divided such that pulp flows to each of the outlet channels;

the valve has an open position allowing the pulp to flow through the valve body and a closed position blocking pulp flow through the valve, and at least one stationary flow distribution plate having a front edge in the valve body and downstream of the valve, wherein the plate is parallel to the pulp flow direction, wherein front edge of the flow distribution plate divides the pulp flowing into the outlet channels.

24. The distribution apparatus of claim 23 wherein the at least one stationary flow distribution plate includes a plurality of stationary flow distribution plates, each of the plates having a front edge in the valve body and downstream of the closing member, and arranged parallel to the pulp flow direction, wherein each plate separates two of the outlet channels.

25. The distribution apparatus of claim 24 wherein each plate is joined to the other plates along a common joint line, which is parallel to the pulp flow direction.

26. The distribution apparatus of claim 25 wherein the common joint line is coaxial to the outlet conduit.

* * * * *